US008099007B2

(12) United States Patent
Tsueda et al.

(10) Patent No.: US 8,099,007 B2
(45) **Date of Patent: *Jan. 17, 2012**

(54) FIXING APPARATUS FOR IMAGE FORMING APPARATUS

(75) Inventors: Yoshinori Tsueda, Fuji (JP); Osamu Takagi, Chofu (JP); Satoshi Kinouchi, Shinjuku-ku (JP); Tetsuo Kitamura, Mishima (JP); Hiroshi Nakayama, Mishima (JP); Yohei Doi, Mishima (JP); Kazuhiko Kikuchi, Yokohama (JP); Masanori Takai, Izunokuni (JP); Toyoyasu Kusaka, Izu (JP); Toshihiro Sone, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 481 days.

This patent is subject to a terminal disclaimer.

(21) Appl. No.: 11/942,078

(22) Filed: Nov. 19, 2007

(65) Prior Publication Data

US 2008/0118283 A1 May 22, 2008

Related U.S. Application Data

(60) Provisional application No. 60/866,682, filed on Nov. 21, 2006.

(51) Int. Cl.
*G03G 15/20* (2006.01)

(52) U.S. Cl. ..... 399/67; 399/320; 399/333

(58) Field of Classification Search ..... 399/67, 399/320, 333

See application file for complete search history.

(56) References Cited

U.S. PATENT DOCUMENTS

| | | | | |
|---|---|---|---|---|
| 3,902,845 | A * | 9/1975 | Murphy | 492/46 |
| 4,109,135 | A * | 8/1978 | Minden et al. | 219/216 |
| 6,898,409 | B2 | 5/2005 | Tsueda et al. | |
| 7,672,632 | B2 * | 3/2010 | Sone et al. | 399/329 |
| 2003/0044704 | A1 * | 3/2003 | Chowdry et al. | 430/62 |
| 2005/0185994 | A1 * | 8/2005 | Inada et al. | 399/328 |
| 2006/0233575 | A1 * | 10/2006 | Uchida et al. | 399/329 |
| 2007/0246457 | A1 | 10/2007 | Tsueda et al. | |
| 2008/0118282 | A1 * | 5/2008 | Takagi et al. | 399/329 |
| 2008/0124109 | A1 | 5/2008 | Sone et al. | |
| 2008/0260437 | A1 | 10/2008 | Takagi et al. | |

FOREIGN PATENT DOCUMENTS

| | | | |
|---|---|---|---|
| CN | 101059680 | | 10/2007 |
| JP | 10074008 | A * | 3/1998 |
| JP | 2002-295452 | | 10/2002 |

OTHER PUBLICATIONS

English Abstract JP10074008 to Kato et al.*

* cited by examiner

*Primary Examiner* — Ryan D Walsh
(74) *Attorney, Agent, or Firm* — Turocy & Watson, LLP

(57) ABSTRACT

In a heat roller of a fixing apparatus according to an embodiment of the present invention, a sleeve is slidable with respect to a supporting roller. Flanges that regulate the sleeve have smooth surfaces, are arranged at gaps apart from a foamed rubber layer of the supporting roller, and freely rotate with respect to the supporting roller. Edges at both ends of the foamed rubber layer of the supporting roller are formed in an R shape and set shorter than the length of a body of the press roller. The sleeve has markings for detecting a state of the heat roller.

20 Claims, 5 Drawing Sheets

FIXING APPARATUS FOR IMAGE FORMING APPARATUS

CROSS REFERENCE TO RELATED APPLICATION

This invention is based upon and claims the benefit of priority from prior U.S. Patent Application 60/866,682 filed on Nov. 21, 2006, the entire contents of which are incorporated herein by reference.

BACKGROUND OF THE INVENTION

1. Field of the Invention

The present invention relates to a fixing apparatus mounted on image forming apparatuses such as a copying machine, a printer, and a facsimile and a roller used in the fixing apparatus, and, more particularly to a fixing apparatus and a roller for an image forming apparatus employing an induction heating system.

2. Description of the Background

In recent years, there are fixing apparatuses of an induction heating system used in image forming apparatuses of an electrophotographic system such as a copying machine and a printer. In the induction heating fixing apparatuses, an eddy-current is generated in a metal conductive layer by a magnetic field generated by supplying predetermined electric power to an induction-current generation coil. The metal conductive layer is instantaneously heated by this eddy-current to heat, for example, a heat roller.

As one of such induction heating fixing apparatuses, for example, JP-A-2002-295452 discloses a roller in which an elastic layer is closed by a covering member including a metal sleeve.

However, in the Patent Document, it is not mentioned that the metal sleeve slides with respect to the elastic layer to be replaceable in the apparatus.

Therefore, development of a fixing apparatus for an image forming apparatus is desired that prevents, when a sleeve having a conductive layer is slidable with respect to an elastic layer, the sleeve from being broken early because of the slide and realizes the extension of service life of not only the sleeve but also a heat generating member.

SUMMARY OF THE INVENTION

According to an aspect of the present invention, there is provided a highly reliable fixing apparatus for an image forming apparatus that prevents a sleeve from being damaged even when the sleeve slides with respect to an elastic layer on a supporting roller surface and realizes the extension of service life of a heat generating member.

According to an embodiment of the present invention, there is provided a roller including a sleeve that has a conductive layer, a supporting roller that has an elastic layer on a surface thereof and slidably supports the sleeve, and regulating members that are attached to both sides of the supporting roller a space apart from at least a part of the elastic layer and regulate a slide range of the sleeve.

DETAILED DESCRIPTION OF THE INVENTION

Figure 1:
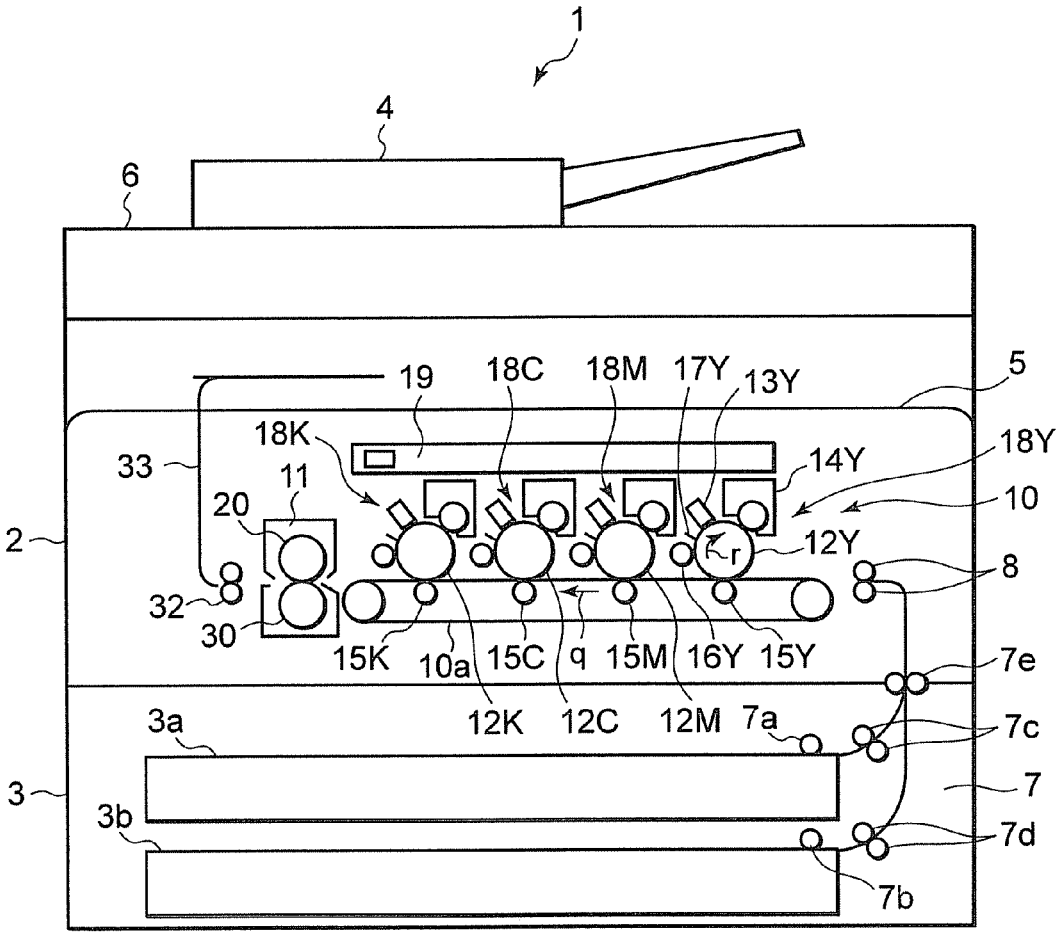
FIG. 1 is a schematic structural view showing an image forming apparatus according to an embodiment of the present invention.

An embodiment of the present invention will be hereinafter explained in detail with reference to the accompanying drawings. FIG. 1 is a schematic diagram showing an image forming apparatus 1 according to the embodiment. The image forming apparatus 1 includes a scanner unit 6 that scans an original and a paper feeding unit 3 that feeds sheet paper P as a recording medium to a printer unit 2 that forms an image. The scanner unit 6 converts image information read from an original supplied by an auto document feeder 4 provided on an upper surface thereof into an analog signal.

The printer unit 2 includes an image forming unit 10 in which image forming stations 18Y, 18M, 18C, and 18K for respective colors of yellow (Y), magenta (M), cyan (C), and black (K) are arranged in tandem along a transfer belt 10*a* rotated in an arrow "q" direction. The image forming unit 10 includes a laser exposure device 19 that irradiates a laser beam corresponding to image information on photoconductive drums 12Y, 12M, 12C, and 12K of the image forming stations 18Y, 18M, 18C, and 18K for the respective colors. Moreover, the printer unit 2 includes a fixing apparatus 11 and a paper discharge roller 32 and has a paper discharging and conveying path 33 that conveys the sheet paper P after fixing to a paper discharging unit 5.

In the image forming station 18Y for yellow (Y) of the image forming unit 10, a charger 13Y, a developing device 14Y, a transfer roller 15Y, a cleaner 16Y, and a charge removing device 17Y are arranged around the photoconductive drum 12Y that rotates in an arrow "r" direction. The image forming stations 18M, 18C, and 18K for the respective colors of magenta (M), cyan (C), and black (K) have the same structure as the image forming station 18Y for yellow (Y).

The paper feeding unit 3 includes first and second paper feeding cassettes 3*a* and 3*b*. In a conveying path 7 for the sheet paper P leading from the paper feeding cassettes 3*a* and 3*b* to the image forming unit 10, pickup rollers 7*a* and 7*b* that extract the sheet paper P from the paper feeding cassettes 3*a* and 3*b*, separating and conveying rollers 7*c* and 7*d*, conveying rollers 7*e*, and registration rollers 8 are provided.

When print operation is started, in the image forming station 18Y for yellow (Y) of the printer unit 2, the photoconductive drum 12Y is rotated in the arrow "r" direction and uniformly charged by the charger 13Y. Subsequently, exposure light corresponding to yellow image information scanned by the scanner unit 6 is irradiated on the photoconductive drum 12Y by the laser exposure device 19 and an electrostatic latent image is formed thereon. Thereafter, a toner is supplied to the photoconductive drum 12Y by the developing device 14Y and a toner image of yellow (Y) is formed on the photoconductive drum 12Y. The toner image of yellow (Y) is transferred onto the sheet paper P, which is conveyed in the arrow "q" direction on the transfer belt 10*a*, in the position of the transfer roller 15Y. After the transfer of the toner image is finished, a residual toner on the photoconductive drum 12Y is cleaned by the cleaner 16Y and the charge on the surface of the photoconductive drum 12Y is removed by the charge removing device 17Y, whereby the photoconductive drum 12Y is allowed to perform next printing.

In the image forming stations 18M, 18C, and 18K for the respective colors of magenta (M), cyan (C), and black (K), toner images are formed in the same manner as the image forming station 18Y for yellow (Y). The toner images of the respective colors formed in the image forming stations 18M, 18C, and 18K are sequentially transferred onto the sheet paper P, on which the yellow toner image is formed, in the positions of the respective transfer rollers 15M, 15C, and 15K. The sheet paper P having a color toner image formed thereon in this way is heated and pressed to have the color toner image fixed thereon and have a print image completed thereon by the fixing apparatus 11 and is discharged to the paper discharging unit 5.

Figure 2:
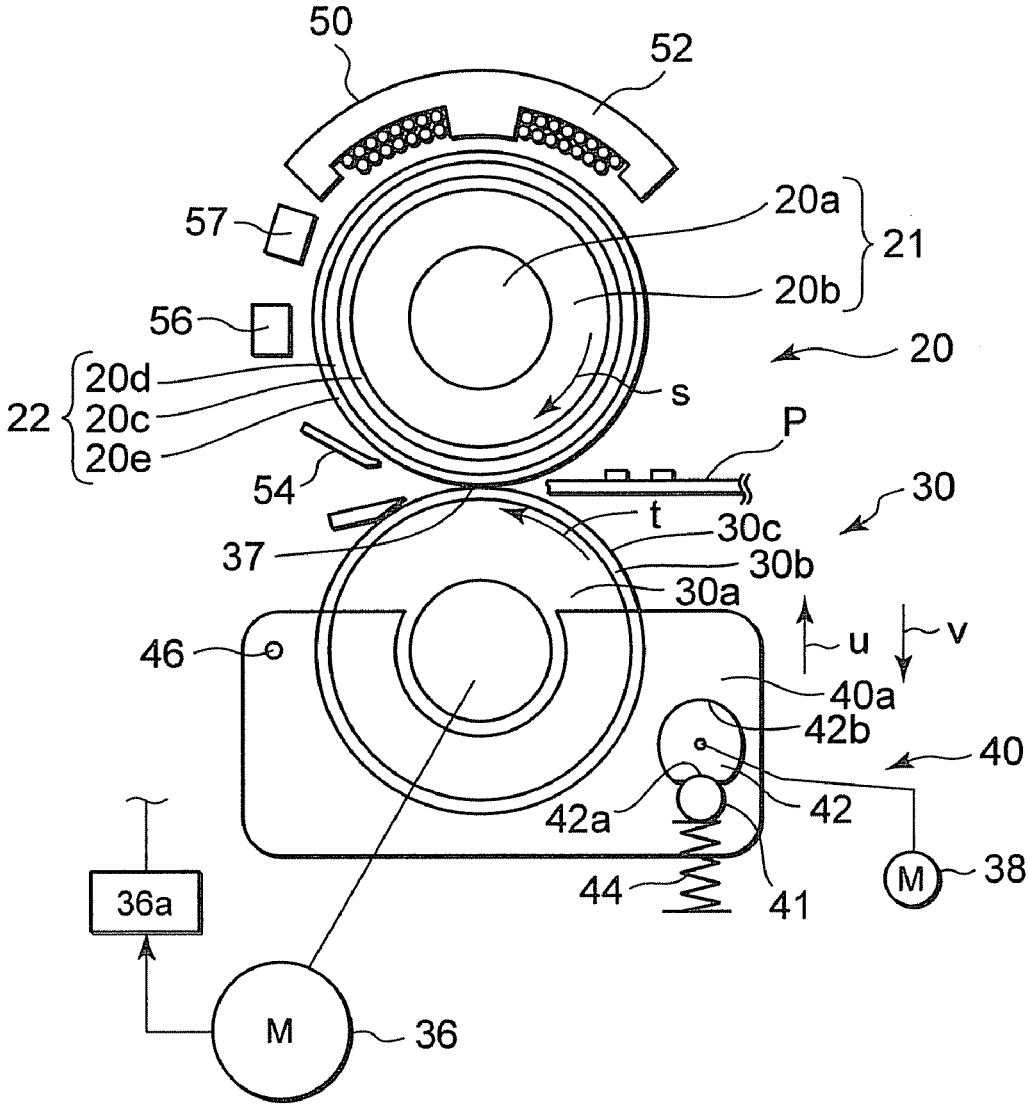
FIG. 2 is a schematic structural view of a fixing apparatus according to the embodiment viewed from an axial direction thereof.
Figure 3:
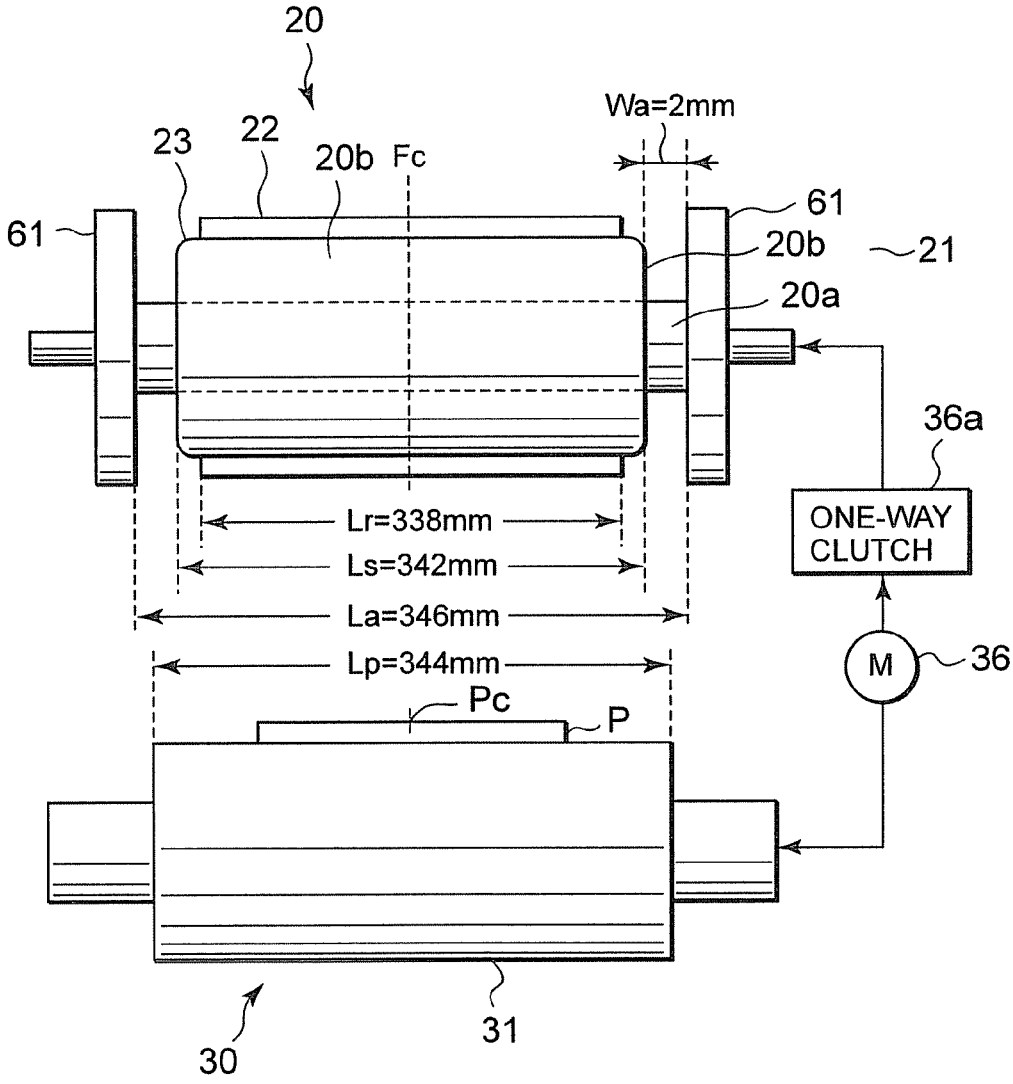
FIG. 3 is a schematic explanatory view of a heat roller and a press roller according to the embodiment viewed from a direction parallel to axes thereof.

The fixing apparatus 11 is described below. As shown in FIGS. 2 and 3, the fixing apparatus 11 has a heat roller 20 as a heat generating member and a press roller 30 as an opposite member. The press roller 30 is driven in an arrow "t" direction by a fixing motor 36. The heat roller 20 is driven by the press roller 30 and is rotated in an arrow s direction. A driving force of the fixing motor 36 is transmitted to the heat roller 20 via a one-way clutch 36*a* (a link mechanism). The one-way clutch 36*a* transmits the driving force of the fixing motor 36 to the heat roller 20 when the rotation of the heat roller 20, which is driven by the press roller 30, is delayed.

When the driving force of the fixing motor 36 is transmitted to the heat roller 20 via the link mechanism, the heat roller 20 is rotated at speed same as that of the press roller 30. When the rotation speed of the heat roller 20 is recovered in this way, the transmission of the driving force of the fixing motor 36 to the heat roller 20 by the one-way clutch 36*a* is stopped. Consequently, deviation between the rotation speeds of heat roller 20 and the press roller 30 is eliminated and fixing performance is improved.

The press roller 30 is brought into press contact with the heat roller 20 and separated from the heat roller 20 by a contact and separation mechanism 40. When the heat roller 20 and the press roller 30 are brought into press contact with each other by the contact and separation mechanism 40, a nip 37 having a definite width is formed between the heat roller 20 and the press roller 30. When sheet paper P passes through such a nip 37 between the heat roller 20 and the press roller 30, a toner image on the sheet paper P is heated and pressed to be fixed thereon. In this embodiment, the sheet paper P is conveyed in center alignment for aligning the center of the sheet paper P and the center of the fixing apparatus 11.

The contact and separation mechanism 40 has a sheet metal 40*a* that supports the press roller 30, a spring 44 that pushes up a shaft 41 provided on the sheet metal 40*a*, and a rotating cam 42 that comes into contact with the shaft 41 and is rotated by a cam motor 38.

When a recess 42*a* of the rotating cam 42 is in contact with the shaft 41, the shaft 41 of the sheet metal 40*a* is pushed up by an elastic force of the spring 44. The sheet metal 40*a* receives a force for rotation in an arrow "u" direction around a fulcrum 46. The heat roller 20 and the press roller 30 are brought into press contact with each other by the force. The pressing force at this time is, for example, about 500 N. On the other hand, when a projection 42*b* of the rotating cam 42 is in contact with the shaft 41, the shaft 41 is pushed down resisting the elastic force of the spring 44. The sheet metal 40*a* receives a force for rotation in an arrow "v" direction around the fulcrum 46. The heat roller 20 and the press roller 30 are separated from each other by the force.

The heat roller 20 has a supporting roller 21 and a sleeve 22. The supporting roller 21 has a core 20*a* of iron (Fe) having a diameter of 30 mm and a foamed rubber layer 20*b* having the thickness of 10 mm and an outer diameter of 50 mm, which is an elastic layer arranged around the core 20*a*. The foamed rubber layer 20*b* is formed of open-cell microcellular foam having an average cell diameter of about 150 microns.

The sleeve 22 is formed by stacking a metal conductive layer 20*c* as a conductive layer of nickel (Ni) having an inner diameter of 50 mm and the thickness of 40 μm, a silicon rubber layer 20*d* having the thickness of 200 μm, and a release layer 20*e* having the thickness of 30 μm. The release layer 20*e* is formed in an outermost peripheral portion of the sleeve 22 and formed of fluorine resin (PFA or PTFE (poly-tetrafluoroethylene) or a mixture of PFA and PTFE). The material of the conductive layer is not limited to nickel and may be stainless steel, aluminum, a composite material of stainless steel and aluminum, or the like. The conductive layer may be obtained by forming resin containing conductive powder or the like in lamination.

The core 20*a* and the foamed rubber layer 20*b* of the supporting roller 21 are fixed to each other. The metal conductive layer 20*c* and the silicon rubber layer 20*d* of the sleeve 22 are fixed to each other. The silicon rubber layer 20*d* and the release layer 20*e* of the sleeve 22 are also fixed to each other. However, the foamed rubber layer 20*b* and the metal conductive layer 20*c* are not fixed to each other. Therefore, the sleeve 22 is slidable with respect to the supporting roller 21. A slip resistant agent is applied over the surface of the supporting roller 21. The slide of the sleeve 22 with respect to the supporting roller 21 is suppressed by the slip resistant agent. In order to suppress the slide between the supporting roller 21 and the sleeve 22, a surface layer of the supporting roller 21 may be machined to increase a coefficient of friction of the surface layer of the supporting roller 21 instead of applying the slip resistant agent. In this way, since the supporting roller 21 and the sleeve 22 are not fixed, the sleeve 22 is replaceable after being used to some extent. By replacing the sleeve 22, it is possible to maintain fixing performance of the fixing apparatus 11. In replacing the sleeve 22, since the core 20*a* and the foamed rubber layer 20*b* constituting the supporting roller 21 can be used without being replaced, the supporting roller 21 is effectively used.

The press roller 30 includes a core 30*a* having an outer diameter of 45 mm, a silicon rubber layer 30*b* having the thickness of 1 mm provided on an outer periphery of the core 30*a*, and a release layer 30*c* of fluorine resin having the thickness of 30 μm that covers an outer periphery of the silicon rubber layer 30*b*. The core 30*a* and the silicon rubber layer 30*b* are fixed by an adhesive or the like. The silicon rubber layer 30*b* and the release layer 30*c* are also fixed by the adhesive or the like.

An induction heating coil 50 that causes the metal conductive layer 20*c* of the heat roller 20 to generate heat is provided around the heat roller 20 at a predetermined gap apart from the heat roller 20. Moreover, around the heat roller 20, a peeling pawl 54 that prevents the sheet paper P after fixing from twining around the heat roller 20, an infrared sensor 56 of a thermopile type that detects a surface temperature of the heat roller 20, and a thermostat 57 that detects abnormality of the surface temperature of the heat roller 20 and shuts off the supply of electric power to the induction heating coil 50 are provided. The peeling pawl 54 may be either a contact type or a non-contact type.

The induction heating coil 50 has a shape substantially coaxial with the heat roller 20 and is formed by winding a wire around a magnetic core 52 for concentrating a magnetic flux on the heat roller 20. As the wire, for example, a litz wire formed by binding plural copper wires coated with heat-resistant polyamide-imide and insulated from one another is used. By using the litz wire as the wire, it is possible to set a diameter of the wire smaller than the depth of penetration of a magnetic field. This makes it possible to effectively feed a high-frequency current to the wire.

Figure 4:
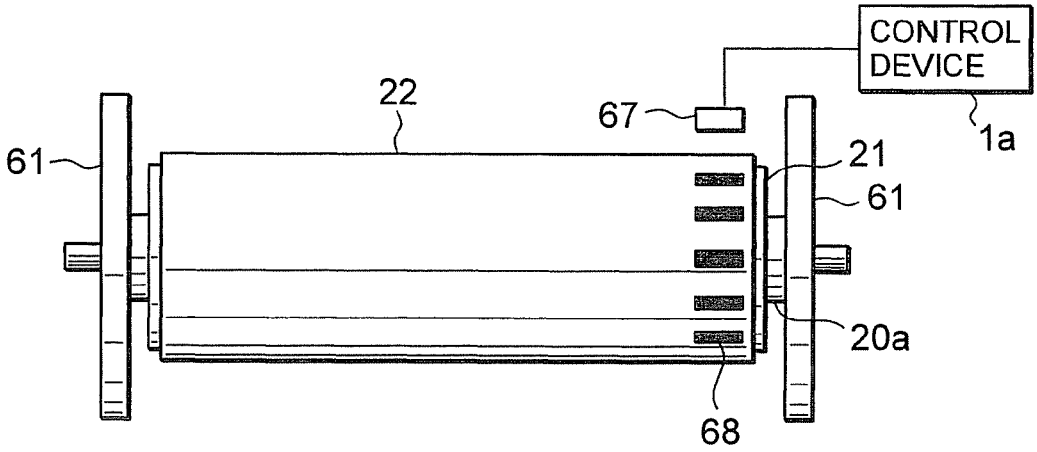
FIG. 4 is a schematic explanatory view showing markings of a sleeve according to the embodiment.

As shown in FIG. 4, markings 68 that are detected by a sensor 67 near the heat roller 20 are formed at an end of the sleeve 22. A shape of the marking 68 is a rectangle long in an axial direction of the heat roller 20. According to the rotation of the heat roller 20, the sensor 67 periodically detects the markings 68 and inputs a detection signal to, for example, a control device 1*a* of a main body of the image forming apparatus 1. Consequently, the image forming apparatus 1 recognizes that the sleeve 22 is normally rotating. On the other hand, when the sleeve 22 slides with respect to the supporting roller 21 and the markings 68 deviate from a detection area, i.e., when the sensor 67 cannot detect the markings 68, the control device 1*a* determines that abnormality has occurred in the sleeve 22.

The markings 68 may be formed in any one of the metal conductive layer 20*c*, the silicon rubber layer 20*d*, and the release layer 20*e* on the sleeve 22. However, it is preferable to form the markings 68 on the outside of a paper passing range of the sheet paper P such as the end of the sleeve 22. When the markings 68 are formed in this way, even if the markings 68 affect a surface shape of the heat roller 20, the fixing performance is not affected. Moreover, during fixing, since the markings 68 are not covered with the sheet paper P, it is possible to prevent misdetection of the markings 68 by the sensor 67.

As the sensor 67, a photo-coupler that optically scans the markings 68, a magnetic sensor that magnetically scans the markings 68, or an infrared temperature sensor may be arbitrarily used. A shape of the markings 68 is not limited and may be an arbitrary shape such square, circular, or elliptical as long as the markings 68 have width in the axial direction of the heat roller 20. Since the marking 68 has width in the axial direction of the heat roller 20, the markings 68 can be scanned by the sensor 67 as long as the sleeve 22 slides with respect to the supporting roller 21 in a predetermined range. As a type of markings, rather than simply written in the sleeve 22, for example, the silicon rubber layer 20*d* and the release layer 20*e* above the metal conductive layer 20*c* are partially removed in some portions or the silicon rubber layer 20*d* and the release layer 20*e* are not partially formed in some portions and the metal conductive layer 20*c* is exposed in those portions to form markings. If such markings are scanned using the infrared temperature sensor or the like, it is possible to detect the rotation or the like of the heat roller 20 on the basis of a difference in a detected temperature.

As shown in FIG. 3, flanges 61 of synthetic resin that are regulating members, have heat resistance, and are not likely to generate a noxious gas during heating are attached to both sides of the core 20*a* of the heat roller 20. The flanges 61 are freely rotatable with respect to the core 20*a*. Length Ls of the foamed rubber layer 20*b* of the heat roller 20 is set to 342 mm and length Lr of the sleeve 22 is set to 338 mm. Distance La between the flanges 61 of the heat roller 20 is set to 346 mm. Length Lp of a body 31 as a contact layer of the press roller 30 that comes into press contact with the heat roller 20 is set to 344 mm. In other words, the heat roller 20 and the press roller 30 are set to satisfy a relation La>Lp>Ls.

Gaps Wa having the width of about 2 mm are provided between the foamed rubber layer 20*b* and the flanges 61. By providing the gaps, when the sleeve 22 slides in the axial direction of the heat roller 20, an escape for the sleeve 22 extending beyond the ends of the foamed rubber layer 20*b* is formed.

Edges 23 at both ends of the foamed rubber layer 20*b* are chamfered to be formed in a convex R shape. By forming the edges 23 in the R shape in this way, it is possible to prevent the stress from concentrating on the metal conductive layer 20*c* in portions of the metal conductive layer 20*c* in contact with the ends of the foamed rubber layer 20*b*. The chamfering of the edges 23 of the foamed rubber layer 20*b* is not limited to the R shape. The edges 23 of the foamed rubber layer 20*b* may be chamfered in a linear shape as long as the stress does not concentrate on the metal conductive layer 20*c*.

Figure 5:
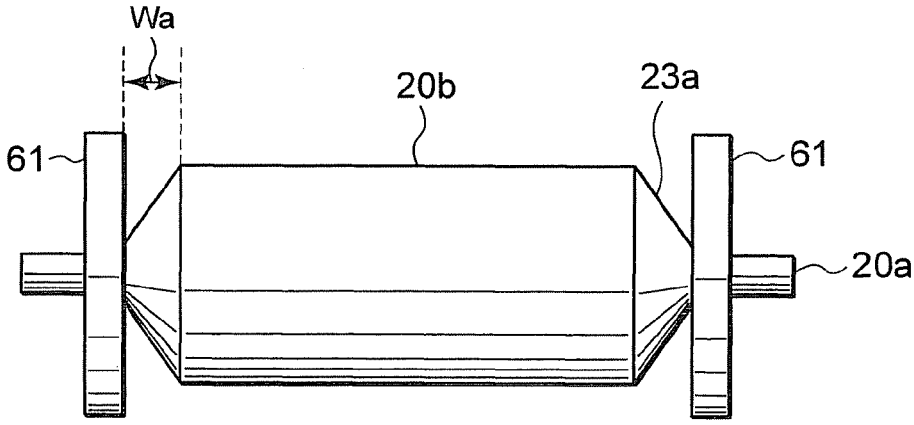
FIG. 5 is a schematic explanatory view showing first another example of edges of a foamed rubber layer of the heat roller according to the embodiment.
Figure 6:
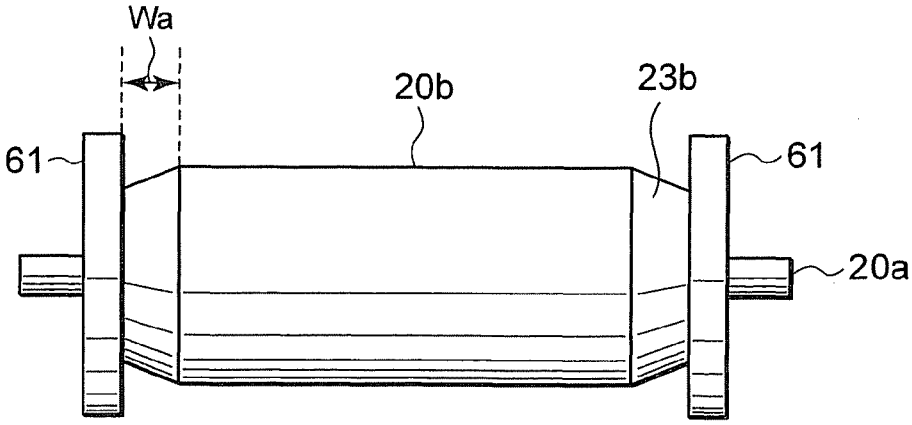
FIG. 6 is a schematic explanatory view showing second another example of the edges of the foamed rubber layer of the heat roller according to the embodiment.

For example, if the edges 23*a* of the foamed rubber layer 20*b* is formed in a taper shape as in first another example shown in FIG. 5, the chambering of the ends of the foamed rubber layer 20*b* is obtained and, at the same time, the gaps Wa having the width of 2 mm can be provided between the foamed rubber layer 20*b* and the flanges 61. Moreover, it is also possible that, as in second another example shown in FIG. 6, a part of the ends of the foamed rubber layer 20*b* is machined in a taper shape, the foamed rubber layer 20*b* is chamfered, and gaps Wa are provided between the foamed rubber layer 20*b* and the flanges 61.

To prevent interference with the flanges 61, both ends of the press roller 30 are machined thin compared with the body 31 thereof. The length Lp of the body 31 of the press roller 30 is set to be larger than the length Ls of the foamed rubber layer 20*b* of the heat roller 20. Consequently, when the heat roller 20 and the press roller 30 are brought into press contact with each other, edges of the body 31 of the press roller 30 is prevented from striking against the surface of the sleeve 22. Therefore, when the heat roller 20 and the press roller 30 are in press contact with each other, the sleeve 22 is not affected by the stress from the edges of the body 31 of the press roller 30.

The surfaces of the inner sides of the flanges 61 opposed to the heat roller 20 are formed smooth. A projection or the like is not provided on the surfaces on the inner sides of the flanges 61. Parting lines and pouring ports for a resin material formed on the surfaces when the flanges 61 made of resin are molded are removed. Since the flanges 61 freely rotate with respect to the core 20*a*, even when the sleeve 22 slides, comes into contact with one of the flanges 61, and is then pressed against the flange 61, the metal conductive layer 20*c* is not scratched by the flange 61. In order to further reduce a frictional force caused between the flange 61 and the sleeve 22 when the flange 61 and the sleeve 22 come into contact with each other, smooth surfaces or slip layers may be provided on the inner surfaces of the flanges 61. The flanges 61 may be fixed to the core 20*a*.

Figure 7:
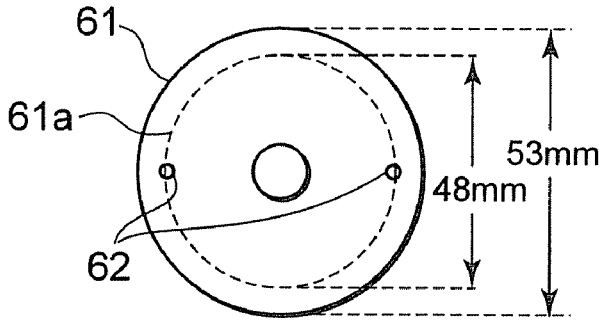
FIG. 7 is a schematic plan view showing a flange according to the embodiment.

As shown in FIG. 7, in each of the flanges 61, air holes 62 for ventilation for preventing the gap Wa between the foamed rubber layer 20*b* and the flange 61 from being closed when the sleeve 22 slides are provided in two places. The flange 61 is formed with an outer diameter 53 mm larger than an outer diameter of the heat roller 20. The two air holes 62 having a diameter of 1 mm are formed on a circumference 61*a* having a diameter of 48 mm on the inside of the flange 61, which is further on the inner side than an inner diameter 50 mm of the sleeve 22. When the sleeve 22 slides and comes into contact with the flange 61, the air discharged from the foamed rubber layer 20*b* when the foamed rubber layer 20*b* thermally expands can be discharged to the outside from the air holes 62. Therefore, it is possible to prevent an air pressure from rising in the sleeve 22 to prevent the roller hardness of the heat roller 20 from increasing and secure a sufficient nip width between the heat roller 20 and the press roller 30.

Even when the sleeve 22 slides in the axial direction of the heat roller 20, the length Lr of the sleeve 22 in the axial direction of the heat roller 20 is large enough for covering a maximum fixing width. In this embodiment, for example, when the maximum fixing width is set to a lateral width 297 mm of the A3 size of the JIS standard and the sheet paper P of the A3 size is passed through the fixing apparatus 11 in center alignment, the sleeve 22 still has a margin of (338−297)+2=20.5 mm from both the ends of the sheet paper P. Therefore, even if the sleeve 22 slides to a position where the sleeve 61 comes into contact with the flange 61, the ends of the sleeve 22 do not enter a fixing area.

Actions are described below. When warm-up is completed and the image forming apparatus 1 comes into a standby mode, in the fixing apparatus 11, electric power in the standby mode is supplied to the induction heating coil 50 and the heat roller 20 maintains a standby temperature. During this period, in the rotating cam 42 of the contact and separation mechanism 40, the projection 42*b* is in contact with the shaft 41 and the press roller 30 is separated from the heat roller 20.

Subsequently, when a print command is issued, the image forming apparatus 1 starts print operation. In the contact and separation mechanism 40 of the fixing apparatus 11, the cam motor 38 is driven, the rotating cam 42 is rotated 180°, and the recess 42*a* of the rotating cam 42 is brought into contact with the shaft 41. Consequently, the press roller 30 comes into press contact with the heat roller 20 and forms a nip 37 between the heat roller 20 and the press roller 30. The fixing motor 36 is started, the press roller 30 drivingly rotates in the arrow "t" direction, and the heat roller 20 is driven to rotate in the arrow "s" direction. When the heat roller 20 and the press roller 30 are brought into press contact with each other, since the body 31 of the press roller 30 is longer than the foamed rubber layer 20*b* of the heat roller 20, the sleeve 22 is not affected by the stress from the edges of the body 31 of the press roller 30 and damage to the metal conductive layer 20*c* due to the pressing of the press roller 30 is prevented.

During the start of rotation of the heat roller 20 and the press roller 30, the heat roller 20 and the press roller 30 are accelerated not suddenly but gradually. Consequently, it is possible to reduce torsion caused in the foamed rubber layer 20*b* and realize the extension of service life of the supporting roller 21. During an operation for stopping the heat roller 20 and the press roller 30, the heat roller 20 and the press roller 30 are gradually decelerated. During the rotation of the press roller 30 and the heat roller 20 by the fixing motor 36, when the driven rotation of the heat roller 20 delays, the one-way clutch 36*a* operates and the driving force of the fixing motor 36 is transmitted to the heat roller 20. Consequently, the heat roller 20 can maintain the rotation at the speed same as that of the press roller 30 and the fixing performance is improved.

Electric power during fixing is supplied to the induction heating coil 50 at substantially the same timing as the rotation of the heat roller 20 and the press roller 30. The heat roller 20 maintains a fixable temperature. Subsequently, the sheet paper P having a toner image formed thereon in the printer unit 2 is inserted through the nip 37 between the heat roller 20 and the press roller 30 to have the toner image heated, pressed, and fixed thereon. The sheet paper P is inserted through the nip 37 in center alignment for aligning the center of the sheet paper P and the center of the heat roller 20.

During this operation, the sensor 67 detects the markings 68 formed on the sleeve 22 of the heat roller 20. When the sensor 67 periodically detects the markings 68, from a result of the detection, the control device 1*a* recognizes that the sleeve 22 is normally rotating.

Figure 8:
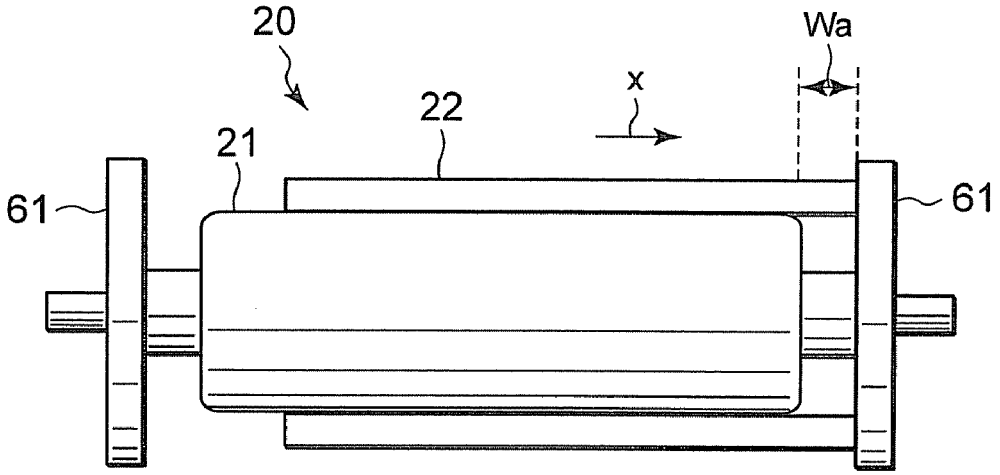
FIG. 8 is a schematic explanatory view showing a state in which the sleeve according to the embodiment has slid to a flange position.

While the heat roller 20 and the press roller 30 rotate while being in press contact with each other, the sleeve 22 of the heat roller 20 slides in, for example, an arrow "x" direction shown in FIG. 8. According to the slide, the sleeve 22 may extend beyond the ends of the supporting roller 21 and come into contact with one of the flanges 61. However, the edges 23 at both the ends of the foamed rubber layer 20*b* are formed in the convex R shape. Therefore, the concentration of the stress on the sleeve 22 by the ends of the foamed rubber layer 20*b* is prevented, damage to the metal conductive layer 20*c* can be prevented, and the extension of service life of the metal conductive layer 20*c* can be realized. The surfaces of the inner sides of the flanges 61 are formed smooth and the flanges 61 are freely rotatable with respect to the core 20*a*. Therefore, when the end of the sleeve 22 come into contact with one of the flanges 61, the flange 61 is associated with the rotation of the sleeve 22, a load on the end of the sleeve 22 can be reduced, damage to the metal conductive layer 20 can be prevented, and the extension of service life of the metal conductive layer 20*c* can be realized.

After coming into contact with the flange 61, the sleeve 22 may further slides. However, since a gap Wa is formed between the foamed rubber layer 20*b* of the supporting roller 21 and the flange 61, the sleeve 22 is freely deformed in the gap Wa. Therefore, even when the sleeve 22 slides by a great degree, a load generated by the regulation by the flange 61 can be reduced and the extension of service life of the sleeve 22 can be realized. When the sleeve 22 is pressed to the flange 61 side after coming into contact with the flange 61, the gap between the foamed rubber layer 20*b* and the flange 61 is closed by the sleeve 22. However, since the air holes 62 are formed in the flange 61, even if the air is discharged from the foamed rubber layer 20*b* by thermal expansion, it is possible to further discharge the air to the outside from the air holes 62 and prevent the air pressure from rising in the sleeve 22. In other words, it is possible to prevent the roller hardness of the heat roller 20 from increasing. As a result, the nip width between the heat roller 20 and the press roller 30 can be sufficiently secured and satisfactory fixing performance can be obtained.

The sheet paper P is passed through the fixing apparatus 11 in center alignment. Therefore, even if the sleeve 22 slides, there is no change in a positional relation between a paper passing area of the sheet paper P and the induction heating coil 50. Thus, the induction heating coil 50 can appropriately cause the metal conduction layer 20*c* in a portion corresponding to the paper passing area to generate heat and satisfactory fixing performance can be obtained.

Moreover, the length Lr of the sleeve 22 in the axial direction of the heat roller 20 is sufficiently larger than the maximum fixing width. Thus, even if the sleeve 22 slides to the position where the sleeve 22 comes into contact with the flange 61, the end of the sleeve 22 does not cover the fixing area and satisfactory fixing performance is obtained.

When the print operation is finished, the fixing apparatus 11 stops the fixing operation and maintains the standby mode. When the fixing operation is stopped, the rotating cam 42 is rotated 180° again, the projection 42*b* of the rotating cam 42 comes into contact with the shaft 41, and the heat roller 20 and the press roller 30 are separated.

When the service life of the sleeve 22 has expired while the fixing is performed in this way, the old sleeve 22 is removed from the supporting roller 21 and replaced with a new sleeve 22 to maintain satisfactory fixing performance. The sleeve 22 is replaced not only periodically but also when abnormality occurs. Abnormality of the sleeve 22 is determined through detection of the markings 68 by the sensor 67.

Even if the sleeve 22 slides during the fixing, if the end of the sleeve 22 is in a range in which the end is regulated by the flange 61, the rectangular markings 68 long in the axial direction are within the detection area of the sensor 67. Therefore, the sensor 67 can detect the markings 68. If a detection result from the sensor 67 is periodic, the control device 1*a* recognizes that the sleeve 22 is normally rotating.

However, when the slide of the sleeve 22 further increases while fixing is performed, the flange 61 may be broken or abnormality such as cut-off of the sleeve 22 may occur. When such abnormality occurs, the sensor 67 cannot detect the markings 68 of the sleeve 22. When the periodic detection result is not obtained from the sensor 67, the control device 1*a* determines that abnormality of the fixing apparatus 11 has occurred and stops the operation of the image forming apparatus 1. If necessary, the control device 1*a* displays an indication of a serviceman call or notifies a user of the abnormality through a network. When the sleeve 22 is broken, the old sleeve 22 is removed and a new sleeve 22 is attached to the supporting roller 21.

In the fixing apparatus 11 according to this embodiment, the heat roller 20 includes the supporting roller 21 and the sleeve 22 slidable with respect to the supporting roller 21 and the sleeve 22 is replaceable. The flanges 61 are arranged with the gaps provided between the flanges 61 and the foamed rubber layer 20*b* of the supporting roller 21 and are freely rotatable with respect to the supporting roller 21 or the surfaces thereof are formed smooth. Consequently, the stress caused when the sleeve 22 comes into contact with one of the flanges 61 is reduced and the extension of service life of the sleeve 22 is realized. In the fixing apparatus 11, the edges 23 at both the ends of the foamed rubber layer 20*b* are formed in the R shape or the body 31 of the press roller 30 is set longer than the foamed rubber layer 20*b* to realize the extension of service life of the sleeve 22 due to the edges of the body 31 and realize the extension of service life of the sleeve 22.

The present invention is not limited to the embodiment described above and various modifications of the present invention are possible without departing from the spirit of the present invention. For example, the structure of the elastic layer is arbitrary and, in the case of a sponge-like material, a size of a cell diameter and the like are not limited. A size of the gaps between the elastic layer and the regulating members, the width of the markings provided on the sleeve, and the like are not limited. Moreover, the opposite member is not limited to the press roller and may be a belt-like member.

What is claimed is:

1. A roller comprising:

a sleeve comprising a conductive layer;

a supporting roller configured to support the sleeve slidably around the supporting roller; and regulating members configured to rotate freely with respect to the supporting roller, configured to be facing both sides of the supporting roller at a predetermined interlayer of space apart from at least a part of the surface of the supporting roller and configured to regulate a slide range of the sleeve.

2. A roller according to claim 1, wherein the supporting roller comprises an elastic layer that is formed by chamfering both ends of the elastic layer on a surface.

3. A roller according to claim 1, wherein the supporting roller comprises an elastic layer that is formed of a sponge-like material having open cell foam on a surface.

4. A roller according to claim 1, wherein the regulating members have air holes in positions corresponding to a further inner side than an inner diameter of the sleeve.

5. A roller according to claim 1, wherein the regulating members have smooth surfaces.

6. A roller according to claim 1, wherein the sleeve has a detectable marking.

7. A roller according to claim 6, wherein the marking has a predetermined width in an axial direction of the supporting roller.

8. A fixing apparatus comprising:

a heat generating member comprising a sleeve comprising a conductive layer and a supporting roller configured to support the sleeve slidably around the supporting roller;

regulating members configured to be facing both sides of the supporting roller at a predetermined interlayer of space apart from at least a part of the surface of the supporting roller, and configured to rotate freely with respect to the supporting roller; and an opposite member configured to press and contact with the heat generating member.

9. A fixing apparatus according to claim 8, wherein the supporting roller comprises an elastic layer that is formed by chamfering both ends of the elastic layer on a surface.

10. A fixing apparatus according to claim 8, wherein the regulating members are rotatable with respect to the supporting roller.

11. A fixing apparatus according to claim 8, wherein the regulating members have air holes in positions corresponding to a further inner side than an inner diameter of the sleeve.

12. A fixing apparatus according to claim 8, wherein the sleeve has a detectable marking formed to have predetermined width in an axial direction of the supporting roller.

13. A fixing apparatus according to claim 8, wherein the supporting roller comprises an elastic layer on a surface, the opposite member is a press roller, and Lp>Ls, if length of the elastic layer is Ls and length of a contact layer of the press roller coming into press contact with the heat generating member is Lp.

14. A fixing apparatus according to claim 8, wherein the opposite member is a press roller, and La>Lp, if length of a contact layer of the press roller coming into press contact with the heat generating member is Lp and distance between the regulating members is La.

15. A fixing apparatus according to claim 8, wherein the opposite member is a press roller, and an outer diameter of the press roller is formed thin in positions opposed to the regulating members.

16. A fixing apparatus according to claim 8, further comprising:

a driving mechanism configured to give a driving force to the opposite member; and an auxiliary driving mechanism configured to give an auxiliary driving force to the heat generating member.

17. A fixing apparatus according to claim 8, further comprising a contact and separation mechanism configured to bring the heat generating member and the opposite member into contact with each other and configured to separate the heat generating member and the opposite member from each other.

18. A fixing apparatus according to claim 9, further comprising an induction-current generating member arranged around the heat generating member.

19. A method of controlling a fixing apparatus comprising:

supporting a sleeve comprising a conductive layer of a heat generating member slidably with a supporting roller;

bringing the heat generating member and an opposite member into press contact with each other;

driving the heat generating member by rotation of the opposite member; and regulating a slide of the sleeve by contacting an end of the sleeve with a regulating, members which are configured to be facing both sides of the supporting roller at a predetermined interlayer of space apart from at least a part of the surface of the supporting roller, and configured to rotate freely with respect to the supporting roller, if the sleeve slides predetermined width in an axial direction while the heat generating member is driven to rotate.

20. A method of controlling a fixing apparatus according to claim 18, further comprising:

detecting a marking formed on the sleeve while the heat generating member is driven to rotate, and determining an abnormality has occurred if the detection of the marking is impossible.

* * * * *